US006572191B2

(12) United States Patent
Wild

(10) Patent No.: US 6,572,191 B2
(45) Date of Patent: Jun. 3, 2003

(54) CHAIR, IN PARTICULAR OFFICE CHAIR, HAVING A SYNCHRONOUS MECHANISM

(75) Inventor: Konrad Wild, Engelthal (DE)

(73) Assignee: Dauphin Entwicklungs- u. Beteiligungs-GmbH, Neukirchen (DE)

( * ) Notice: Subject to any disclaimer, the term of this patent is extended or adjusted under 35 U.S.C. 154(b) by 0 days.

(21) Appl. No.: 09/907,621

(22) Filed: Jul. 19, 2001

(65) Prior Publication Data

US 2002/0003367 A1 Jan. 10, 2002

(30) Foreign Application Priority Data

Jul. 8, 2000 (DE) ..... 100 33 418

(51) Int. Cl.[7] ..... A47C 1/024

(52) U.S. Cl. ..... 297/301.4; 297/300.1; 297/463.1; 297/373

(58) Field of Search ..... 297/300.7, 300.8, 297/375, 374, 300.2, 300.3, 300.1, 373, 463.1

(56) References Cited

U.S. PATENT DOCUMENTS

| | | | | | |
|---|---|---|---|---|---|
| 2,043,433 | A | * | 6/1936 | Gabb | 297/373 |
| 4,747,640 | A | * | 5/1988 | Locher | 297/291 |
| 5,295,731 | A | * | 3/1994 | Dauphin | 297/300.1 |
| 5,447,357 | A | * | 9/1995 | Dauphin | 297/301.4 |
| 5,486,056 | A | * | 1/1996 | Thorn | 297/354.12 |
| 5,964,503 | A | * | 10/1999 | Inoue | 297/300.1 |
| 6,120,096 | A | * | 9/2000 | Miotto | 297/300.1 |
| 6,131,998 | A | * | 10/2000 | Su | 297/300.5 |
| 6,283,549 | B1 | | 9/2001 | Husemann | |
| 6,322,144 | B1 | * | 11/2001 | Gebhard | 297/300.1 |

FOREIGN PATENT DOCUMENTS

| | | | | |
|---|---|---|---|---|
| DE | 4014154 | A1 * | 11/1991 | A47C/1/027 |
| EP | 0 584 620 | A1 | 3/1994 | |
| EP | 0 698 358 | A2 | 2/1996 | |
| EP | 0 995 371 | A | 4/2000 | |
| GB | 1 597 474 | | 9/1977 | |
| WO | WO 99/45823 | | 9/1999 | |

* cited by examiner

*Primary Examiner*—Peter M. Cuomo
*Assistant Examiner*—Stephanie Harris
(74) *Attorney, Agent, or Firm*—Browdy and Neimark, P.L.L.C.

(57) ABSTRACT

A chair, in particular office chair, comprises a pedestal; a seat support supported thereon by a chair column and having front and rear seat support elements which are interconnected by a pivot axis; a seat supported on the seat support elements; a backrest fixed to the rear seat support element; and an adjustable-length energy storing device which is articulated to the seat support elements at a distance from the pivot axis thereof, sing for adjustment relative to each other of the backrest and the seat, with one seat support element being equipped with a receptacle for the upper end of the chair column. The receptacle on the seat support element is articulated to the seat support element by way of an articulated axis which is parallel to the pivot axis of the front and rear seat support element. The seat support element is provided with a rack detent arrangement which acts between the seat support element and the receptacle, arresting and releasing various inclinations of the seat support relative to the chair column.

11 Claims, 5 Drawing Sheets

CHAIR, IN PARTICULAR OFFICE CHAIR, HAVING A SYNCHRONOUS MECHANISM

BACKGROUND OF THE INVENTION

1. Field of the Invention

The invention relates to a chair, in particular an office chair, comprising a pedestal; a seat support supported thereon by a chair column and having front and a rear seat support elements which are interconnected by a pivot axis; a seat supported on the seat support elements; a backrest fixed to the rear seat support element; an adjustable-length energy storing device, which is articulated to the seat support elements at a distance from the pivot axis thereof, serving for adjustment relative to each other of the back-rest and the seat; a receptacle, which is provided on a seat support element and lodges the upper end of the chair column, with the receptacle being articulated to the seat support element by way of an articulated axis that is parallel to the pivot axis of the front and rear seat support element; a detent arrangement, which acts between the seat support element and the receptacle, arresting and releasing various inclinations relative to the chair column of the seat support which is equipped with the receptacle.

2. Background Art

A chair of the generic type is known from U.S. Pat. No. 5,447,357. This chair has a front seat support element, in which is disposed a bearing element that can be pivoted in relation thereto. This pivoting helps adjust the inclination of the seat support relative to the chair column. For this pivoting motion to be arrested, provision is made for an arrangement of lamellar packs of mutually clamping action. In the pivoting direction, arresting takes place by frictional engagement. A drawback resides in that complete arresting cannot be ensured in the case of greater forces being exercised on the detent arrangement, for instance by heavy-weight persons.

SUMMARY OF THE INVENTION

It is an object of the invention to further develop a chair of the generic type such that, regardless of the given adjustment in inclination by reason of the synchronous mechanism, the seat together with the backrest are as effectively fixable as possible in various inclined positions for the limit angles of inclination of the seat and backrest that are defined by the synchronous mechanism to be variable within a range of adjustment.

This object is attained by the feature according to which the detent arrangement is a rack detent arrangement. The gist of the invention resides in the provision of a rack detent arrangement, the advantage of which resides in that arresting in the pivoting direction takes place by positive locking instead of frictional engagement. In this way, especially efficient arresting is possible.

Additional features and details of the invention will become apparent from the ensuing description of an exemplary embodiment, taken in conjunction with the drawings.

DESCRIPTION OF THE PREFERRED EMBODIMENT

Figure 1:
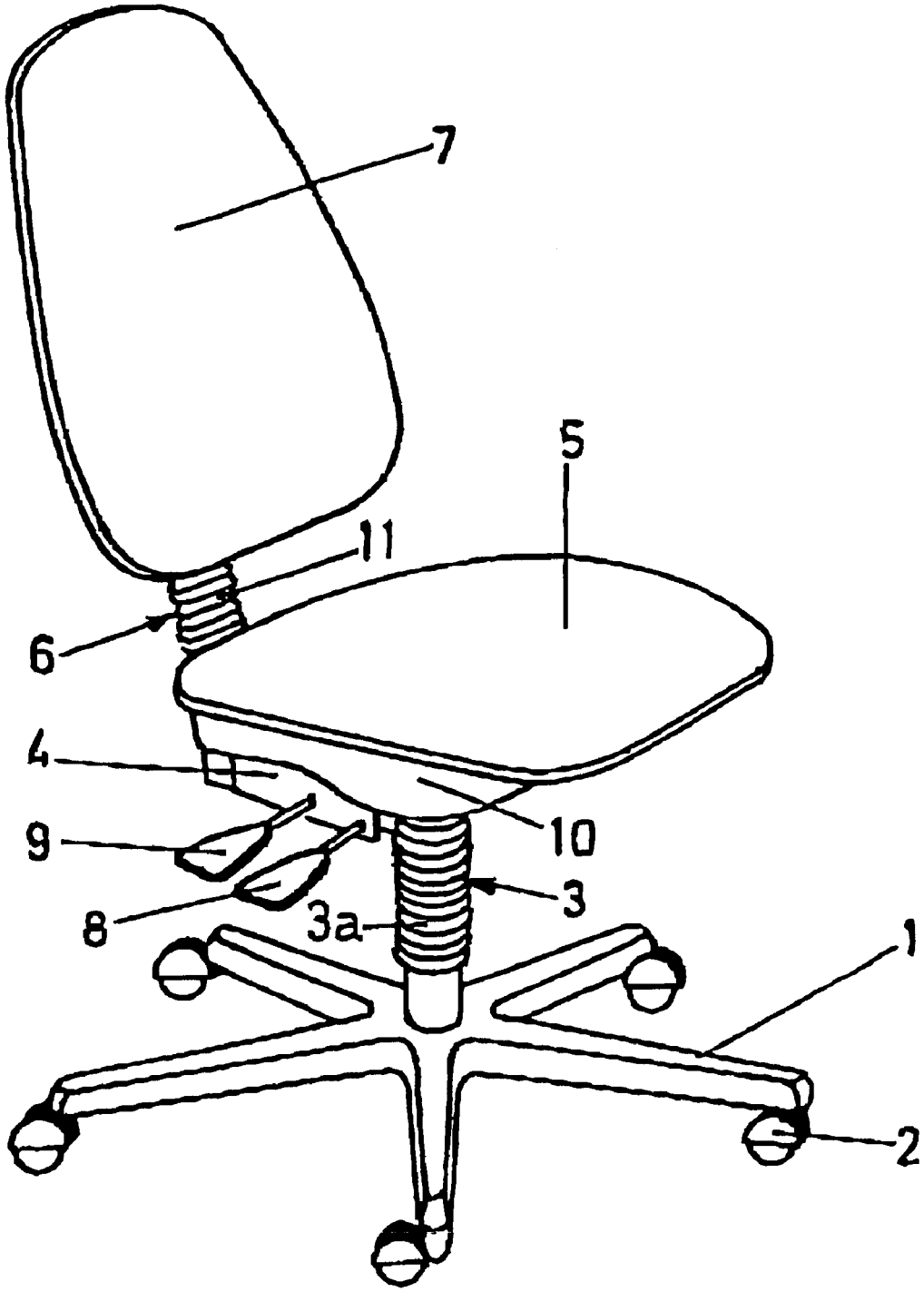
FIG. 1 is a perspective view of an office chair according to the invention.

An office chair illustrated in FIG. 1 comprises a pedestal 1, supported via casters 2 on the ground. A chair column 3 adjustable in height and surrounded by bellows 3*a* is attached to the pedestal 1. To the upper end of the chair column 3 a seat support 4 is detachably secured, on which an upholstered seat 5 is disposed. A backrest support 6, which extends substantially upwards and to the upper end of which a backrest 7 is secured, is arranged on the seat support 4. Height adjustment of the chair column 3 is performed by means of an operating lever 8. For the purpose of changing the inclination of the backrest 7 together with backrest support 6 while simultaneously changing the inclination of the seat 5, a further actuating lever 9 is mounted on the seat support 4. The seat support 4 may be partially or substantially covered optically by a casing 10 arranged on the bottom side of the seat 5. As can be seen from FIG. 1, the backrest support 6 is coated by bellows 11 for optical reasons.

The described basic construction of the office chair is generally known. The adjustable-height chair column 3 is known for instance from U.S. Pat. No. 3,711,054 or from U.S. Pat. No. 3,656,593. The construction of the seat support 4 including the described pivoting possibilities of backrest 7 and seat 5 is known for instance from U.S. Pat. No. 4,966,412.

Figure 2:
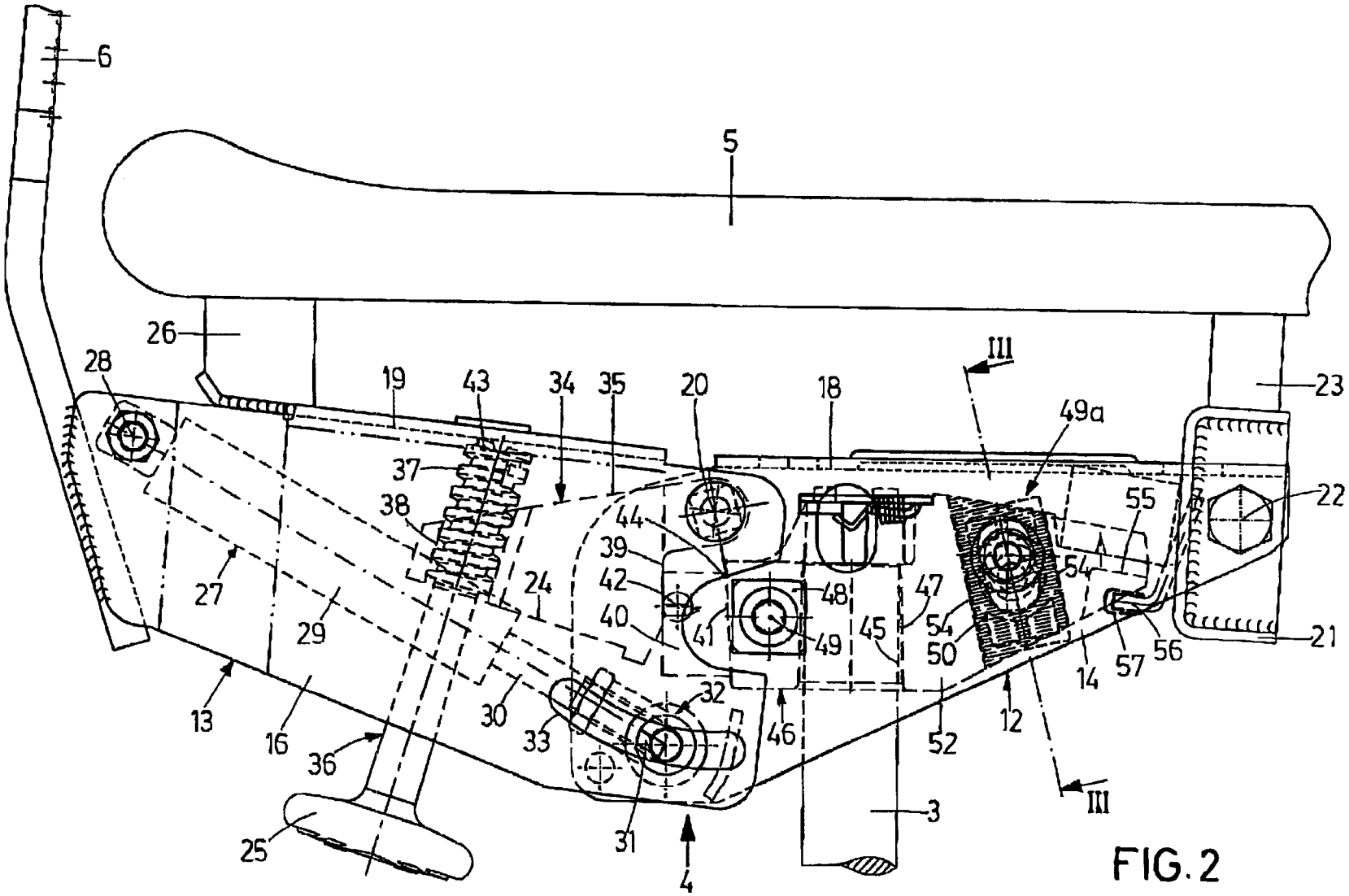
FIG. 2 is a side view of the seat element base construction.
Figure 3:
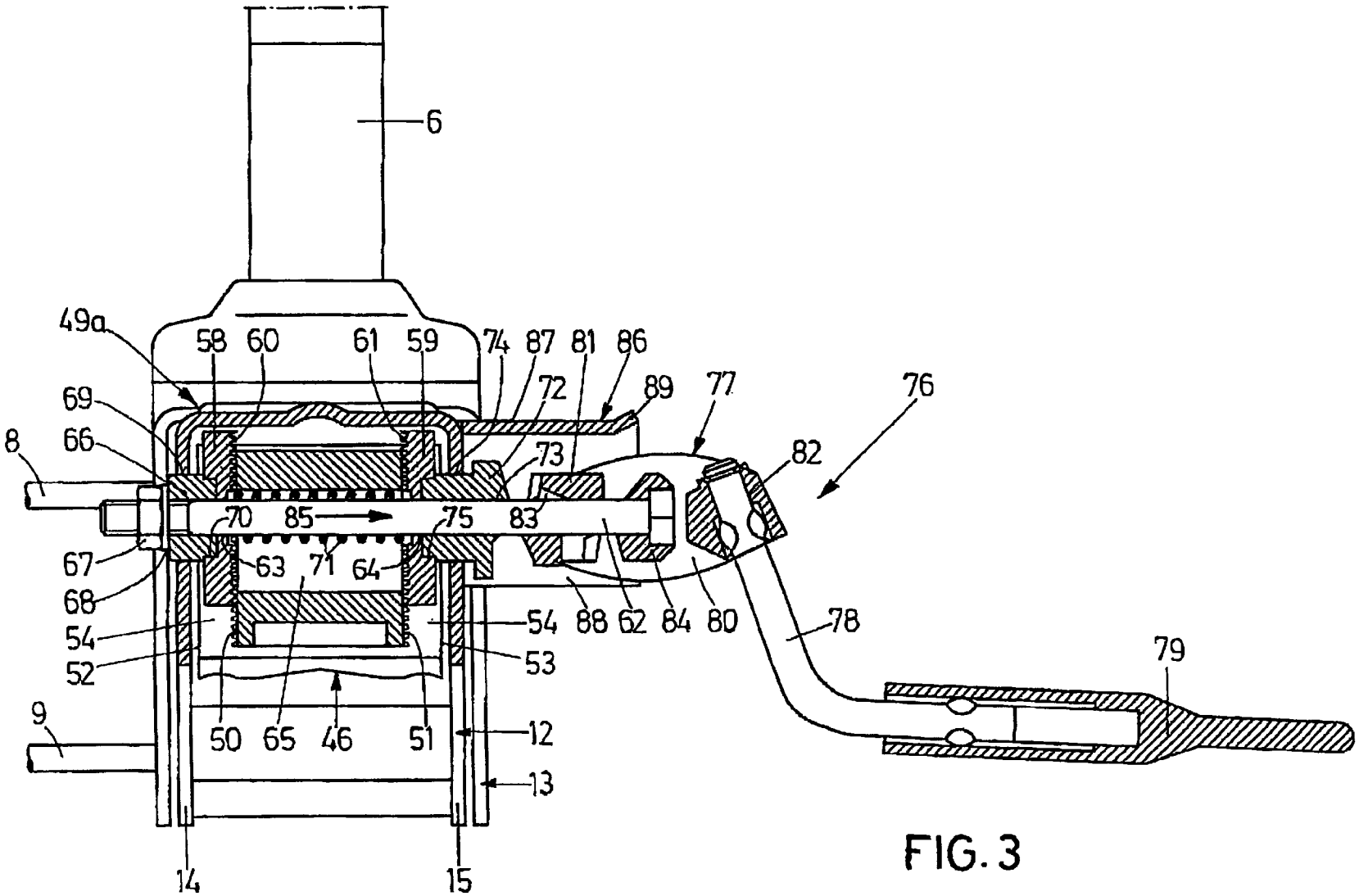
FIG. 3 is a cross-sectional view of the base construction on the line III—III of FIG. 2 in the arrested position.

As can be seen from FIGS. 2 and 3, the seat support 4 is divided. It consists of a front seat support element 12 and a rear seat support element 13, which have a substantially U-shaped cross section which is open downwards. This results in that they comprise two side walls 14, 15 or 16, 17, respectively, which are interconnected by bottoms 18 or 19, respectively, facing the seat 5. The two seat support elements 12, 13 are interconnected by a pivot axis 20 that is arranged adjacent to their bottoms 18, 19.

On the front end of the seat support 4, a seat holder 21 is arranged to be pivotable about a pivot axis 22, the seat holder 21 being formed by a profile extending at right angles to the main plane of symmetry of the chair, i.e. at right angles to the plane of the drawing of FIG. 2. On this seat holder 21, the seat 5 is supported via spacers 23.

The seat 5 is furthermore supported on, and secured to, the bottom 19 of the rear seat support element 13 by means of elastic buffers 26

On the rear end of the rear seat support element 13, i.e. in the region where the backrest support 6 is secured to the rear seat support element 13, a longitudinally adjustable energy storing device in tie form of a longitudinally adjustable gas spring 27 is articulated about a pivot axis 28, which is parallel to the pivot axes 20 and 22. The housing 29 of the gas spring 27 faces this pivot axis 28, a piston rod 30 being extracted from the other end of the gas spring 27. An actuating pin 31, by means of which a valve that is located in the gas spring can be actuated for length adjustment, protrudes from the piston rod 30. By means of a thread the piston rod 30 is connected with an actuating device 32 comprising the actuating lever 9. This actuating device 32 is supported between the side walls 14, 15 of the front seat support element 12 to be pivotable parallel to the pivot axes 20, 22, 28. The actuating lever 9 is guided through and out of an oblong hole 33 in the associated side wall 16 of the rear seat support element 13, this oblong hole being curved in such a manner that its center coincides with the pivot axis 20. Any length adjustment of the gas spring 27 will result in the front seat support element 12 and the rear seat support element 13 being pivoted relative to each other about the pivot axis 20, which on the one hand causes the inclination of the seat 5 to be changed and on the other hand the backrest support 6 with the backrest 7 to be pivoted simultaneously. Devices of this type are designated as so-called synchronous mechanisms. If he actuating pin 31 is pushed into the piston rod 30 of the gas spring 27 not just for a short time in order to achieve a change of length of the gas spring 27 and thus a change of the position of the seat 5 and the backrest 7, but if the actuating pin 31 is pushed into the piston rod 30 for a prolonged time, then the seat 5 together with the backrest 7 can be tilted.

The construction of the seat support 4 with the seat 5—as far as it has been described—is known from U.S. Pat. No. 4,966,412. The construction and arrangement of the actuating device 32 and of the gas spring 27 are known from U.S. Pat. No. 4,662,680.

A spring abutment 34 of angle-lever-type cross-sectional design is supported to pivot about the pivot axis 20 of the front and rear seat support element 12 or 13, respectively. An abutment lever 35 extends from the pivot axis 20 backwards, i.e. in the direction towards the backrest support 6, and that below the bottom 19 of the rear seat support element 13.

By means of its external thread 37, an adjusting screw 36 is arranged in an internal thread 38 on the abutment lever 35 in the vicinity of the free end thereof. The threads 37, 38 are not self-locking. The free end of the adjusting screw 36 supports itself against the bottom 19 of the rear seat support element 13.

The other abutment lever 39, which extends approximately vertically of the lever 35 downwards from the pivot axis 20, bears against a spring 40 formed by a block of elastic material, for example a celled polyurethane elastomer that is commercially available under the designation Vulkocell. The other end of this spring abuts against a stationary, however pivotable abutment 41, which is formed by a rear wall, located opposite the lever 39, of the bearing element 46, which is described in detail below. The spring 40 is secured to a pin-like projection 42 of the lever 39 so that it cannot fall out downwardly from the region between the lever 39 and the abutment 41.

If—as is shown in FIG. 2—the external thread 37 of the adjusting screw 36 is completely screwed through the internal thread 38 of the spring abutment 34, the abutment lever 39 is in its position next to the abutment 41, i.e. the spring 40 is biased most strongly. Once again it is emphasized that the abutment 41 is arranged within the front seat support element 12.

If, with the gas spring 27 unlocked, the backrest 6 is pivoted backwards, the portions located below the pivot axis 20 of the front and the rear seat support elements 12 or 13, respectively, are pivoted towards each other, i.e. the spring 40 is compressed more strongly while this backward pivoting movement of the backrest 7 is progressively damped. This counterforce of the spring 40 thus progressively counteracts the backward pivoting motion of the backrest 7. When the backrest 7 is relieved, its pivoting forward is assisted by a corresponding release of the spring 40, this assisting force diminishing while the backrest 7 pivots forward.

If the adjusting screw 36 is screwed downwardly out of the abutment lever 35 so far that its pilot end 43 is approximately flush with the lever 35, the spring 40 cannot be effective during the entire possible range of pivoting of the front and the rear seat support element 12, 13 i.e., it is not pressed together between the abutment 41 and the abutment lever 39 while producing a corresponding counterforce.

In any intermediate positions of the adjusting screw 36, the spring 40 is engaged in case of correspondingly varying pivoting positions of the rear seat support element 13 in relation to the front seat support element 12, i.e. in the case of varying backward inclinations of the backrest 7 and thus of the seat 5. In addition, in these intermediate positions, at first only an edge 44 of the block-like spring 40 rests on the abutment 41, which contact steadily increases with a further pivoting motion for full-face rest on the abutment 41. This gives also rise to the fact that a certain progression in the spring action is achieved.

For the spring abutment 34 per se being resistant to bending, the levers 35, 39 are reinforced by one or more intermediate webs 24. In order to prevent the adjusting screw 36 from being inadvertently screwed out of the internal thread 38, its external thread is slit and pinched in usual manner in the vicinity of its end 43. In order to permit easy operation of the adjusting screw 36, it is provided with a twist handle 25 on its end protruding downwardly out of the seat support 4. The adjusting screw 36 is displaced in relation to the gas spring 27. The gas springs 27 are commercially available and are generally known with regard to construction and mode of operation for instance from U.S. Pat. No. 3,656,593.

For additional adjustment of inclination of the entire seat 5 with the synchronous mechanism, the front seat support element 12 is articulated to the upper end, forming a bearing cone 45, of the chair column 3 via a bearing element designated as 46 in its entirety. The bearing element 46 of aluminum diecasting is seated by an internally cone-shaped bearing block 47 on the bearing cone 45 of the chair column 3. The bearing block 47 is fastened in a longitudinally oriented rectangular tube 48, which on its side located downstream of the bearing block 47, supports an articulated axis 49 in the form of a simple screw and nut that is parallel to the pivot axis 20. The front seat support element 12 is articulated to this articulated axis 49.

For the seat 5 to be arrested in a certain inclined position, the front seat support element 12 is provided with a rack detent arrangement **49*a* which is disposed before the bearing block 47, acting between the front seat support element 12 and the bearing element 46. It has two parallel racks 50, 51 which form a single piece with the bearing element 46. The racks 50, 51 stand back inwardly from the parallel outer walls 52, 53. The racks 50, 51 are defined by guide walls 54 which are perpendicular to the indentations of the racks 50, 51. Provided on the free end of the bearing element 46 that is turned towards the pivot axis 22 is a stop edge 55, which is parallel to the pivot axis 22 and cooperates with a stop 56, which is joined to the seat support element 12 and has a plastic coating 57. The pivotability of the seat support element 12 relative to the chair column 3 is defined by the stop edge 55 and the stop 56. The detent arrangement 49*a* further comprises two parallel rack jaws 58, 59, which are substantially cuboid, having a jaw rack 60 and 61 on the side turned toward the racks 50 and 51. The indentations the racks 60 and 61 are dimensioned such that they may engage with the indentations of the racks 50 and 51 i.e., they are parallel to, and uniformly spaced from, each other so that optimal indenting is possible. The racks 58, 59 are received with play in the guide walls 54 which guide them laterally. The rack jaws 58, 59 are held by a clamping bolt 62, which may act on them by force in the direction of the racks 50 and 51. Centrically, the rack jaws 58, 59 have holes 63, 64 for the clamping bolt 62 to pass through. Between the racks 50, 51, the bearing element 46 has an oblong hole 65, which is substantially parallel to the clamping bolt 62. On the—in FIG. 3—left end of the clamping bolt 62, provision is made for an actuation sleeve 66, which encircles the clamping bolt 62 and which is fixed by a nut 67 and a shim 68 towards the free end of the clamping bolt 62. The actuation sleeve 66 is displaceably guided through a drilled hole 69 in the side wall 14. On the side tamed towards the rack jaw 58, the actuation sleeve 66 has an annular groove 70 which engages with a corresponding recess of the rack jaw 58. The rack jaws 58 and 59 are prestressed outwards in the direction of the side walls 14 and 15 by a helical compression spring 71, which encircles the clamping bolt 62. In the vicinity of the side wall 15, the clamping bolt 62 is guided through an actuation block 72 with a drilled hole 73 for the clamping bolt 62 to reach through. The actuation block 72 is displaceably guided through a drilled hole 74 in the side wall 15 and has an annular groove 75 on the side turned toward the rack jaw 59, the groove 75 meshing with a corresponding recess of the rack jaw 59. The actuation sleeve 66 and the actuation block 72 serve as guide elements for the clamping bolt 62**.

In the vicinity of the—in FIG. 3—right end of the clamping bolt 62, provision is made for a clamping device 76 for the rack jaws 58, 59 to be actuated by force in the direction of the racks 50 and 51. The clamping device 76 comprises a main clamping body 77, which cooperates with the actuation block 72; an actuating lever 78, which is connected with the main clamping body 77; and a handle 79, which is provided on the free end of the actuating lever 78. The main clamping body 77 has two parallel side walls 80 of substantially cross-sectional shape. The side walls 80 are interconnected by a spreader 81 and a lever receptacle 82, with the spreader 81 and the lever receptacle 82 being disposed in the vicinity of the two ends of the side walls 80. The spreader 81 has a guide channel 83 which the clamping bolt 62 is passed through. Provided between the spreader 81 and the lever receptacle 82 is an actuating head 84, which is disposed on, and connected with, the free end of the clamping bolt 62 and fixes the main clamping body 77 in a direction of clamping 85. The side wall 15 is joined to a downwardly open guide section 86 of the cross sectional shape of a U. The guide section 86 has an upper wall 87 as well as two parallel guide walls 88 connected therewith. In the vicinity of its free end, the upper wall 87 has a web 89 sloping slightly upwards from the horizontal. The side walls 80 and the sides of the actuation block 72 that are turned towards the guide walls 88 are guided between the guide walls 88 with play and non-rotatably relative to the clamping bolt 62.

On the side turned toward the main clamping body 77, the actuation block 72 has a cam 90 with two flanks 91 and 92 defining the cam 90 laterally. On the side turned toward the actuation block 72, the spreader 81 has a cam 93 with two flanks 94, 95 defining it laterally. On the opposite side, the spreader 81 has a cam 96 with flanks 97, 98 defining it. The guide channel 83 has the shape of two drilled holes that are misaligned by an angle so that pivoting of the spreader 81 out of the arrested position seen in FIG. 3 about the clamping bolt 62 into the free pivoted position seen in FIG. 4. The guide channel 83 is defined upwards by two channel walls 99, 100 which are offset by an angle from each other. Downwards the guide channel 83 is defined by two channel walls 101, 102 which intersect substantially at right angles. On the side turned toward the spreader 81, the actuation head 84 has a cam 103 as well as flanks 104 and 105 that define the cam 103 laterally. On the side turned toward the actuation head 84, the lever receptacle 82 has a projection 106, which reduces the gap between the lever receptacle 82 and the actuation head 84 sufficiently far so that human extremities such as the fingers of playing children cannot be pushed in and get caught when the main clamping body 77 is pivoted.

Figure 4:
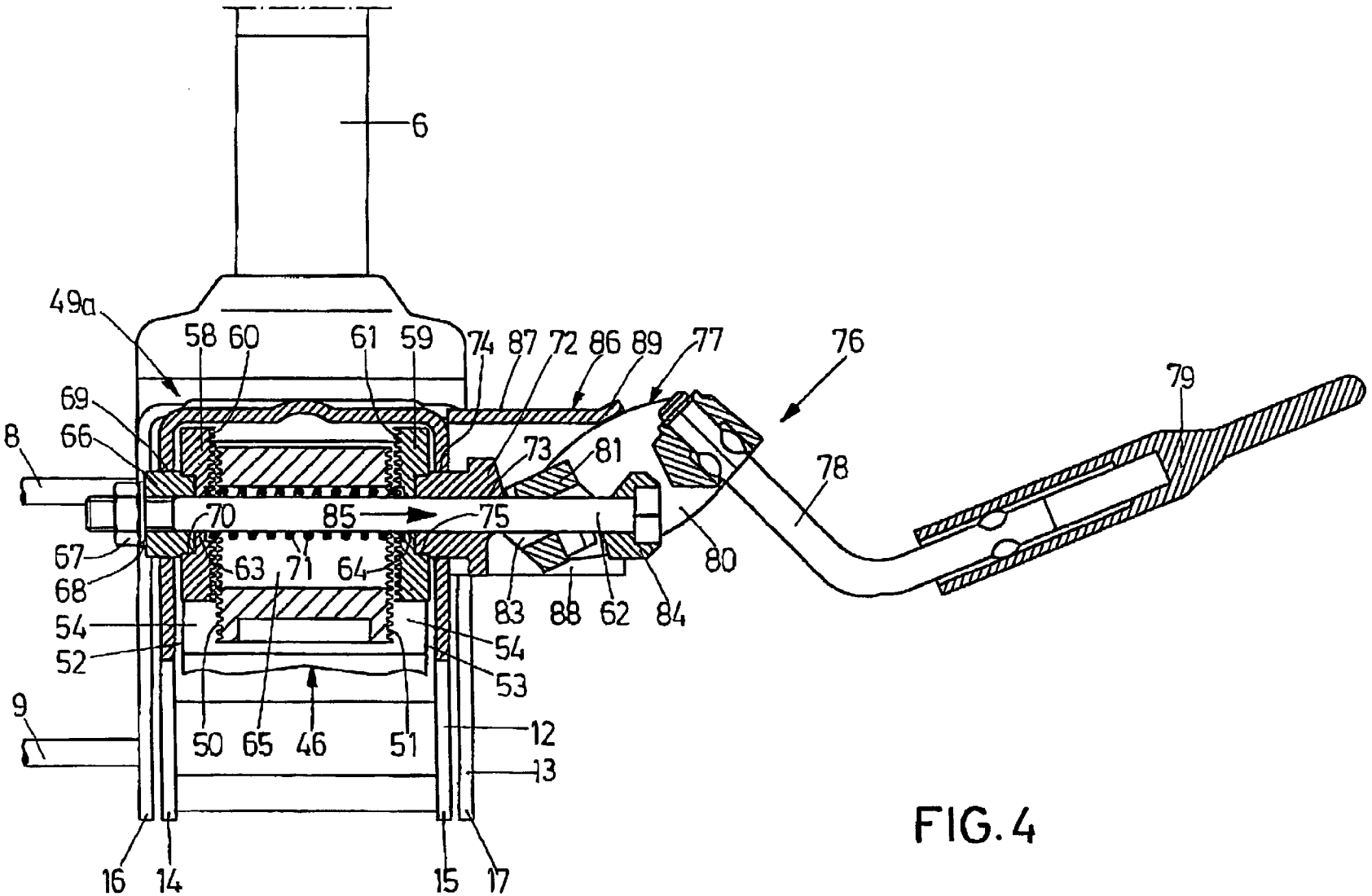
FIG. 4 is a view according to FIG. 3 in the free pivoted position.
Figure 6:
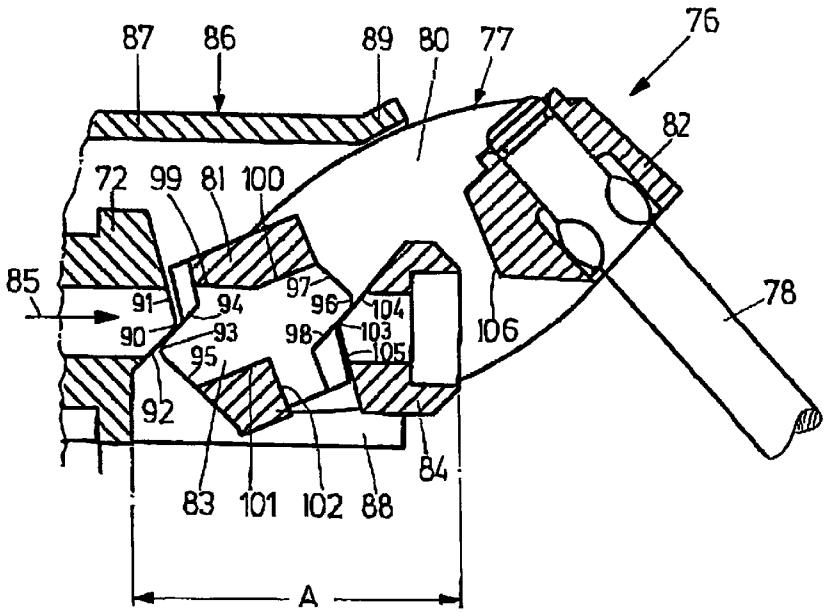
FIG. 6 is a view, on an enlarged scale, of a detail of FIG. 4.
Figure 5:
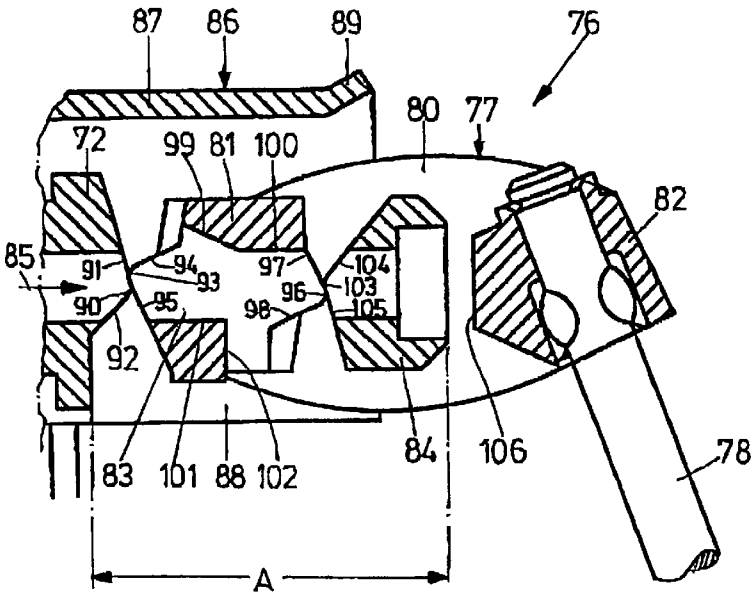
FIG. 5 is a view, on an enlarged scale, of a detail of FIG. 3.

The following is a description of the way of arresting of the bearing element 46 in relation to the front seat support element 12 and the subsequent release thereof, taken in conjunction with FIGS. 3 and 4 and the details in FIGS. 5 and 6. The arrested position is illustrated in FIG. 3 and FIG. 5. The actuating lever 78 is in the lower stop position. The spreader 81 is in the maximally spread position i.e., the actuation head 84 and the actuation block 72 are pressed apart as far as possible. In this position, the cam 96 rests on the flank 105 and the cam 93 on the flank 91. In this position, the actuation block 72 forces the rack jaw 59 with the racks 61 into the racks 51. The actuation sleeve 66 forces the rack jaws 58 with the racks 60 into the racks 50. Pivoting the bearing element 46 relative to the seat support element 12 is not possible in this arrested position. For release of the arrest, the actuating lever 78 is pivoted upwards into the free pivoted position seen in FIG. 4 and partially in FIG. 6. During the pivoting process, the cams 93 and 96 migrate along the cams 90 and 103 which abut there-against, with the block 72 and the head 84 moving further apart and the force of the spring 71 counteracting the pivoting motion. The point of contact of the cams 90 and 93 as well as 96 and 103 is a dead center position. Once the user has pivoted the actuating lever 78 beyond the dead center position, the lever 78 moves automatically into the free pivoted position seen in FIGS. 4 and 6. In this position, the side walls 80 bear against the web 89. The cam 90 bears against the flank 94 and the cam 96 against the flank 104. In this position, the distance A between the actuation head 84 and the actuation block 72 is smaller than in the arrested position seen in FIGS. 3 and 5. Consequently, the force acting on the rack jaws 58 and 59 in the direction toward the racks 50 and 51 is lower than it is in the arrested position so that the helical compression spring 71 can force the rack jaws 78 and 79 apart for them to disengage from the racks 50 and 51. In the free pivoted position, the bearing element 46 can therefore be pivoted relative to the front seat support element 12. The user of the chair has two possibilities of adjusting the inclination relative to the chair column 3. On the one hand he can effectively arrest the inclination relative to the chair column 3 in a given position. A special advantage of the rack detent resides in that positive locking is obtained in the direction of pivoting i.e., substantially perpendicularly to the lengthwise extension of the racks 50, 51, so that even major forces for instance by heavyweight persons can be absorbed without any inadvertent adjustment of inclination. On the other hand, the arrest may be released. In this case, the optimal inclination relative to the chair column 3 as results from the user's seated position will be set automatically. This helps prevent the user from using a fixed inclination relative to the chair column 3 that might not be optimal anatomically. The seat 5 follows suit to any forward or backward inclination of the user.

What is claimed is:

1. A chair, in particular an office chair, comprising:

a pedestal (1);

a seat support (4) supported thereon by a chair column (3) and having a front and a rear seat support element (12, 13) which are interconnected by a pivot axis (20);

a seat (5) supported on the front and rear seat support elements (12, 13);

a backrest (7) fixed to the rear seat support element (13);

an adjustable-length energy storing device (27), which is articulated to the front and rear seat support elements (12, 13) at a distance from the pivot axis (20) thereof, serving for adjustment relative to each other of the backrest (7) and the seat (5);

a receptacle (47), which is provided on said front seat support element (12) and lodges the upper end of the chair column (3), with the receptacle (47) being articulated to the front seat support element (12) by way of an articulated axis (49) that is parallel to the pivot axis (20) of the front and rear seat support elements (12, 13); and a detent arrangement, which acts between the front seat support element (12) and the receptacle (47), arresting and releasing various inclinations relative to the chair column (3) of the seat support (4) which is equipped with the receptacle (47);

wherein the detent arrangement is a rack detent arrangement (49*a*) which comprises:

two racks (50, 51) which are joined to the receptacle (47);

two rack jaws (58, 59) which are joined to the front seat support element (12), cooperating with the two racks (50, 51);

said two racks (50, 51) and said two rack jaws (58, 59) to be intermeshed in pairs;

wherein the two rack jaws (58, 59) are displaceably disposed on a clamping bolt (62).

2. A chair according to claim 1, wherein the rack detent arrangement (49*a*) comprises a clamping device (76) for arresting and releasing the rack detent arrangement (49*a*).

3. A chair according to claim 2, wherein the clamping device (76) is pivotable between a first stop position and a second stop position.

4. A chair according to claim 3, wherein, between the first stop position and the second stop position, the clamping device (76) passes a dead center position.

5. A chair according to claim 1, wherein the front seat support element 12 comprises drilled holes (69, 74), in which guide elements (66, 72) are displaceably guided, housing the clamping bolt (62).

6. A chair according to claim 1, wherein the rack detent arrangement (49*a*) comprises a helical compression spring (71) for the rack jaws (58, 59) to be forced apart.

7. A chair, in particular an office chair, comprising:

a pedestal (1);

a seat support (4) supported thereon by a chair column (3) and having a front and a rear seat support element (12, 13) which are interconnected by a pivot axis (20);

a seat (5) supported on the front and rear seat support elements (12, 13);

a backrest (7) fixed to the rear seat support element (13);

an adjustable-length energy storing device (27), which is articulated to the front and rear seat support elements (12, 13) at a distance from the pivot axis (20) thereof, serving for adjustment relative to each other of the backrest (7) and the seat (5);

a receptacle (47), which is provided on said front seat support element (12) and lodges the upper end of the chair column (3), with the receptacle (47) being articulated to the front seat support element (12) by way of an articulated axis (49) that is parallel to the pivot axis (20) of the front and rear seat support elements (12, 13); and a detent arrangement, which acts between the front seat support element (12) and the receptacle (47), arresting and releasing various inclinations relative to the chair column (3) of the seat support (4) which is equipped with the receptacle (47);

wherein the detent arrangement is a rack detent arrangement (49*a*) which comprises:

two racks (50, 51) which are joined to the receptacle (47);

two rack jaws (58, 59) which are joined to the front seat support element (12), cooperating with the two racks (50, 51);

said two racks (50, 51) and said two rack jaws (58, 59) to be intermeshed in pairs;

wherein the two rack jaws (58, 59) are displaceably disposed on a clamping bolt (62); and wherein the rack detent arrangement (49*a*) comprises spring means (71) for forcing apart the rack jaws (58, 59).

8. A chair according to claim 7, wherein the rack detent arrangement (49*a*) comprises a clamping device (76) for arresting and releasing the rack detent arrangement (49*a*).

9. A chair according to claim 8, wherein the clamping device (76) is pivotable between a first stop position and a second stop position.

10. A chair according to claim 9, wherein, between the first stop position and the second stop position, the clamping device (76) passes a dead center position.

11. A chair according to claim 7, wherein the front seat support element (12) comprises drilled holes (69, 74), in which guide elements (66, 72) are displaceably guided, housing the clamping bolt (62).

* * * * *